US005713569A

United States Patent [19]

Girard et al.

[11] Patent Number: 5,713,569

[45] Date of Patent: Feb. 3, 1998

[54] PRINTER INCLUDING AN OPENING RECEIVING A STACK OF PRINTABLE MEDIA

[75] Inventors: James J. Girard; Mike H. Okamura, both of Boise, Id.

[73] Assignee: Hewlett-Packard Company, Palo Alto, Calif.

[21] Appl. No.: 668,708

[22] Filed: Jun. 24, 1996

[51] Int. Cl.[6] ..... B65H 1/02

[52] U.S. Cl. ..... 271/149; 271/145; 271/164; 271/171

[58] Field of Search ..... 271/31.1, 127, 271/145, 149, 157, 160, 164, 171, 9.09, 117, 109

[56] References Cited

U.S. PATENT DOCUMENTS

| | | | |
|---|---|---|---|
| 3,720,408 | 3/1973 | Horn | 271/145 |
| 4,222,557 | 9/1980 | Wu | 271/149 |
| 4,415,263 | 11/1983 | Hoffman | 271/145 |
| 4,958,825 | 9/1990 | Onomoto et al. | 271/149 |
| 5,085,422 | 2/1992 | Sagara | 271/145 |
| 5,326,090 | 7/1994 | Hock et al. | 271/162 |
| 5,332,209 | 7/1994 | Romansky et al. | 271/171 |
| 5,346,197 | 9/1994 | Takano et al. | 271/171 |
| 5,417,413 | 5/1995 | Huffman et al. | 271/225 |

FOREIGN PATENT DOCUMENTS

| | | | |
|---|---|---|---|
| 0064429 | 4/1984 | Japan | 271/31.1 |
| 401028127 | 1/1989 | Japan | 271/9.09 |
| 0267225 | 10/1989 | Japan | 271/117 |
| 405132166A | 5/1993 | Japan | 271/117 |
| 406144621A | 5/1994 | Japan | 271/117 |

*Primary Examiner*—H. Grant Skaggs

[57] ABSTRACT

A printer comprising a housing, an opening in the housing sized to receive a stack of items of printable media therethrough, an abutment inside the housing, below the opening, supporting the stack of paper, and a door pivotally supported by the housing relative to the opening and movable between a closed position, and an open position.

13 Claims, 3 Drawing Sheets

PRINTER INCLUDING AN OPENING RECEIVING A STACK OF PRINTABLE MEDIA

FIELD OF THE INVENTION

The invention relates to printers. More particularly, the invention relates to receptacles for holding stacks of printable media prior to printing.

BACKGROUND OF THE INVENTION

Table top printers include one or more paper trays that are sized to house a stack of printable media, such as paper, envelopes, transparencies, etc. When the stack has been used up, the user of the printer must remove the tray, place the tray on a work surface, remove a tray cover from the tray, load a new stack into the tray, replace the tray cover, and replace the tray.

This operation requires a work surface on which to place the lid and the tray, and requires that the user perform multiple steps. Users find this operation annoying, and have a perception that these trays are cheap and flimsy.

Some smaller printers, such as bubble jet printers, have inclined paper feed areas at the back of the printers, leading to an opening at the bottom of the back of the printer, and do not include a paper tray. These printers do not provide a crisp streamlined appearance.

SUMMARY OF THE INVENTION

The invention provides a printer comprising a housing, an opening in the housing large enough to receive a stack of items of printable media therethrough, a receptacle in the housing, spaced apart from the opening, receiving and engaging the stack, a door pivotally supported by the housing relative to the opening and movable between a closed position at least partially closing the opening, and an open position, and a feed mechanism, separate from the receptacle, separately feeding individual items of the stack from the receptacle to a print mechanism.

One aspect of the invention provides a printer comprising a housing, an opening in the housing sized to receive a stack of items of printable media therethrough, an abutment inside the housing, below the opening, supporting the stack of paper, and a door pivotally supported by the housing relative to the opening and movable between a closed position, and an open position.

Another aspect of the invention provides a laser printer comprising means defining a housing having a bottom for placement on a generally horizontal surface, having a top opposite the bottom, and having a front transverse to the bottom; means defining a slot in the front of the housing, between the top and the bottom of the housing, for receiving a stack of pieces of paper therethrough, the slot having a top and bottom; means defining a door pivotally supported by the housing means relative to the slot and movable between a closed position closing the opening, and an open position; biasing means biasing the door means toward the closed position, the biasing means being overcome by gravity operating on a stack which is placed against the door means; control means for controlling operation of the printer, the majority of the control means being on the front of the housing; receptacle means in the housing, spaced apart from the slot means, for receiving and engaging the stack; support means telescopically supported by the housing for movement between a use position where the support means extends upward and away from a location of the housing proximate the bottom of the slot and a non-use position where the support means does not extend from the bottom of the slot, the support means supporting a portion of the stack, outside the housing, relative to the slot means; laser print means in the housing for printing on a sheet of paper; paper size selection means, actuable from outside the housing, for selectively guiding different sized stacks of paper inserted into the receptacle means; and feed means, separate from the receptacle means, for separately feeding individual pieces of paper of the stack from the receptacle means to the print means.

DESCRIPTION OF THE DRAWINGS

FIG. 3 is a broken away side view of the printer of FIG. 1 showing the door in a closed position, and showing the paper support in a non-use position.

DETAILED DESCRIPTION OF THE INVENTION

This disclosure of the invention is submitted in furtherance of the constitutional purposes of the U.S. Patent Laws "to promote the progress of science and useful arts". U.S. Constitution, Article 1, Section 8.

Figure 1:
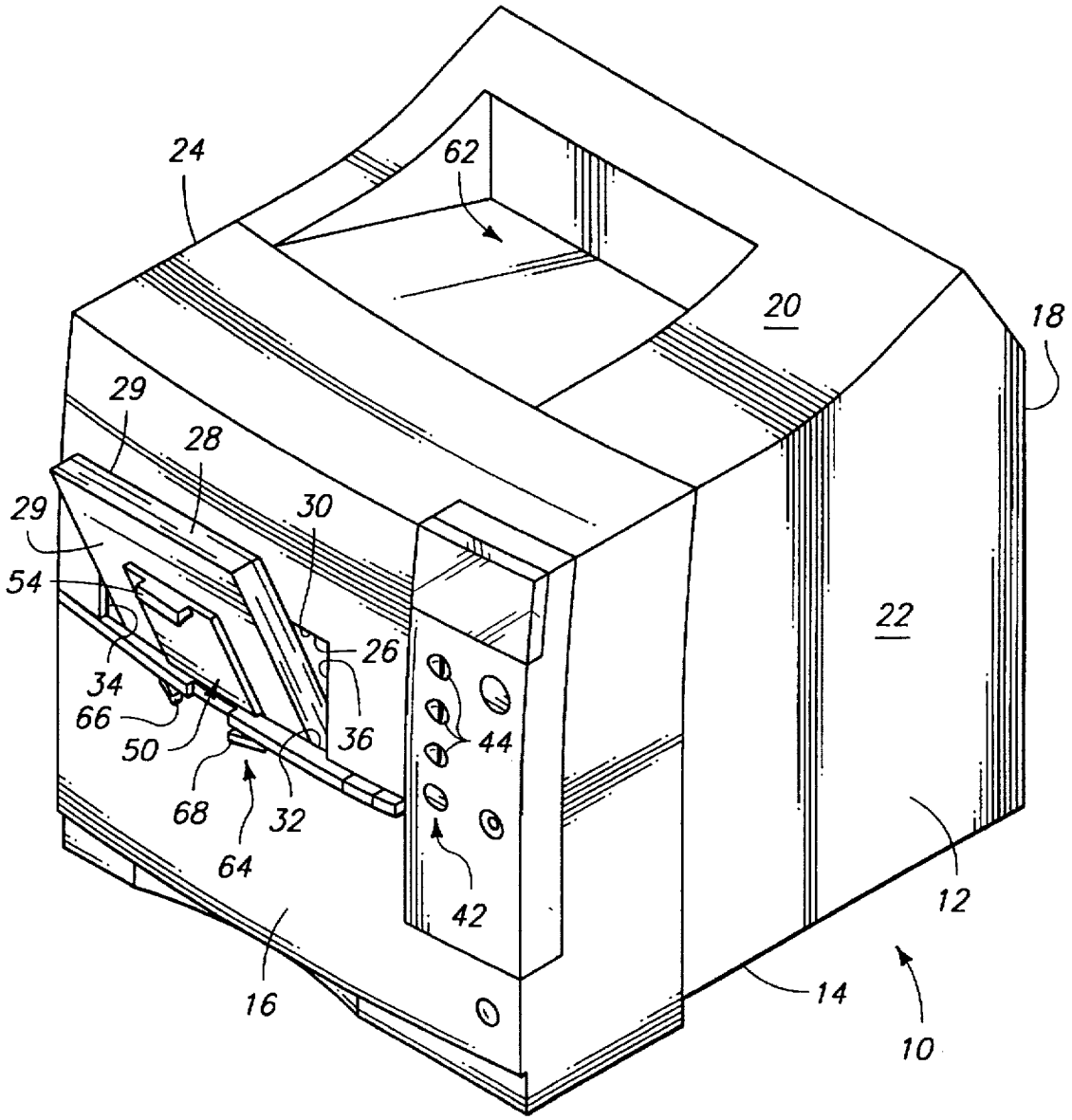
FIG. 1 is a perspective view illustrating a printer embodying the invention, and including a door in an open position, and a paper support in use position and supporting a stack of paper.

FIG. 1 shows a printer 10 embodying the invention. The printer 10 includes a housing 12 having a bottom 14 for placement on a generally horizontal surface, such as on a table top. The printer 10 has a front 16 generally transverse to the bottom 14, a back 18 opposite the front 16, a top 20 opposite the bottom 14, and opposite sides 22 and 24. While other shapes are possible, in the illustrated embodiment, the housing 12 is in the general shape of a cube.

Figure 4:
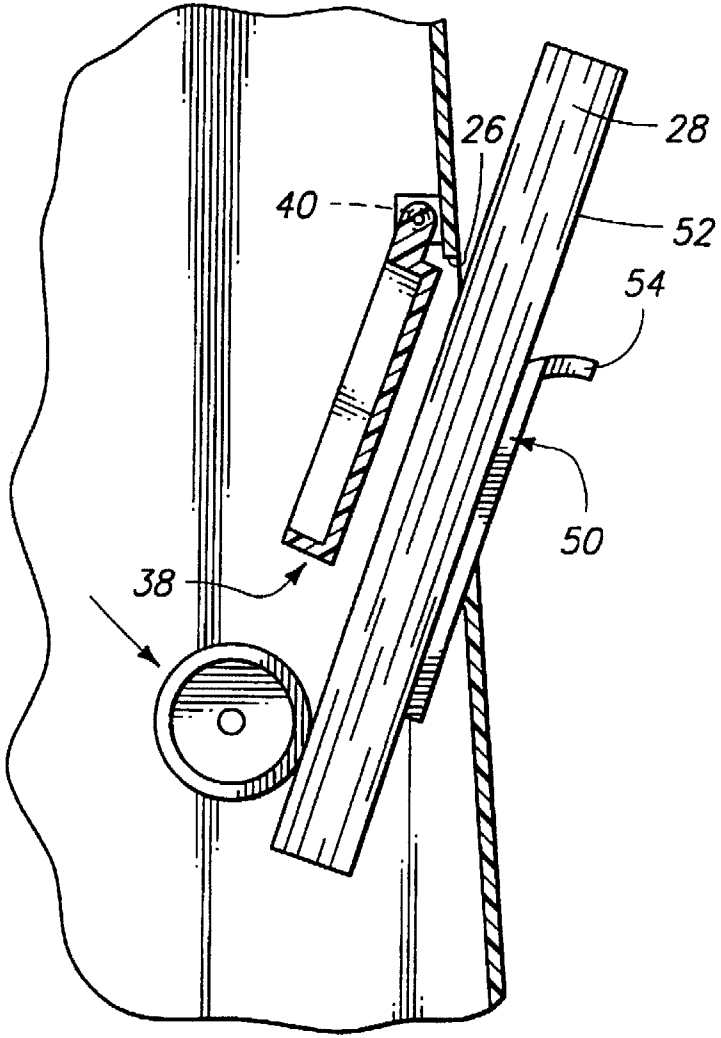
FIG. 4 is a broken away side view of the printer of FIG. 1 showing the door in an open position, and showing the paper support in a use position.
Figure 5:
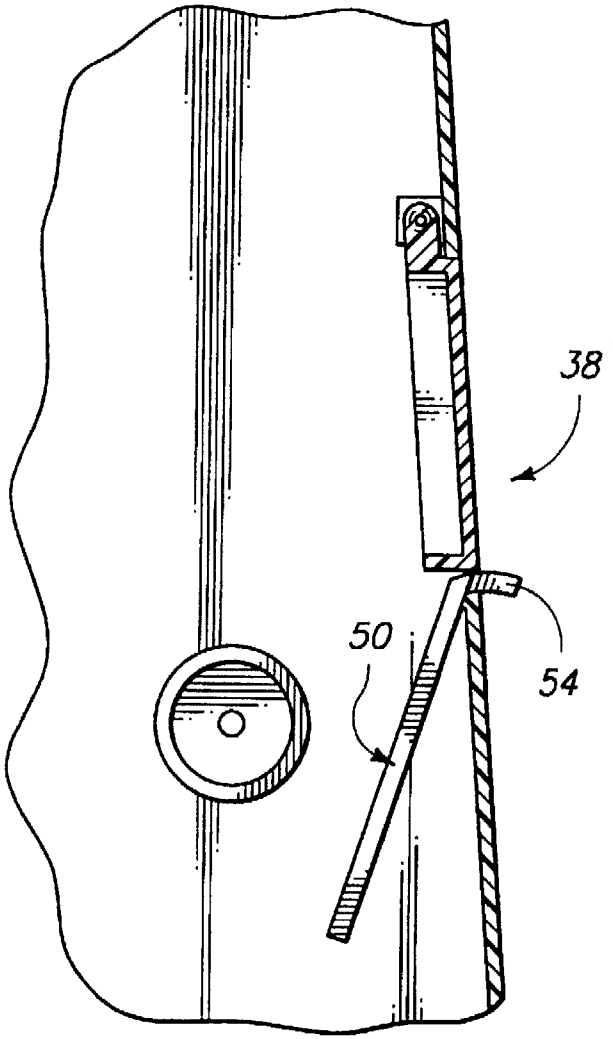

The printer 10 includes a slot or opening 26 in the front of the housing 12 for receiving a stack 28 of items 29 of printable media therethrough such as a stack of paper. The opening 26 has a top 30, bottom 32 and opposite sides 34 and 36. In the illustrated embodiment, the opening 26 has a width between the opposite sides 34 and 36 that is large enough to receive a stack of 8½11 paper inserted lengthwise into the opening 26. The opening 26 has a height between its top 30 and bottom 32 that is large enough to receive at least 200 sheets of printable media. Other heights and widths are possible for the opening 26. The printer 10 further includes a door 38 pivotally supported by the housing 12 relative to the opening 26. The door 38 is movable between a closed position at least partially closing the opening 26 (FIG. 3), and an open position (FIG. 4).

The printer 10 further includes a spring 40, such as a torsion spring, biasing the door means toward the closed position. The spring 40 is easily overcome when a user inserts a stack 28 of paper into the opening 26. Thus, the spring 40 does not cause the door 38 to exert a force on the stack 28 that is so high that it damages the stack 28. The spring 40 can be overcome by gravity operating on a stack 28 which is placed against the door 38, without the user needing to exert any substantial force on the door 38. The door 38 has an appearance and operation similar to a VCR door.

The printer 10 further includes controls 42 for controlling operation of the printer. In the illustrated embodiment, the controls 42 comprise electronic switches 44 such as an "on-line/off-line" switch, etc. In an alternative embodiment, the printer 10 includes a screen, and the controls comprise a menu switch, and switches for toggling through and selecting menu items that appear on the screen. The majority (more than half) of these switches 44 are on the side of the housing 12 having the opening 26; i.e., the front of the housing 12. More particularly, in the illustrated embodiment, most of these switches 44 are on the front of the housing 12.

Figure 2:
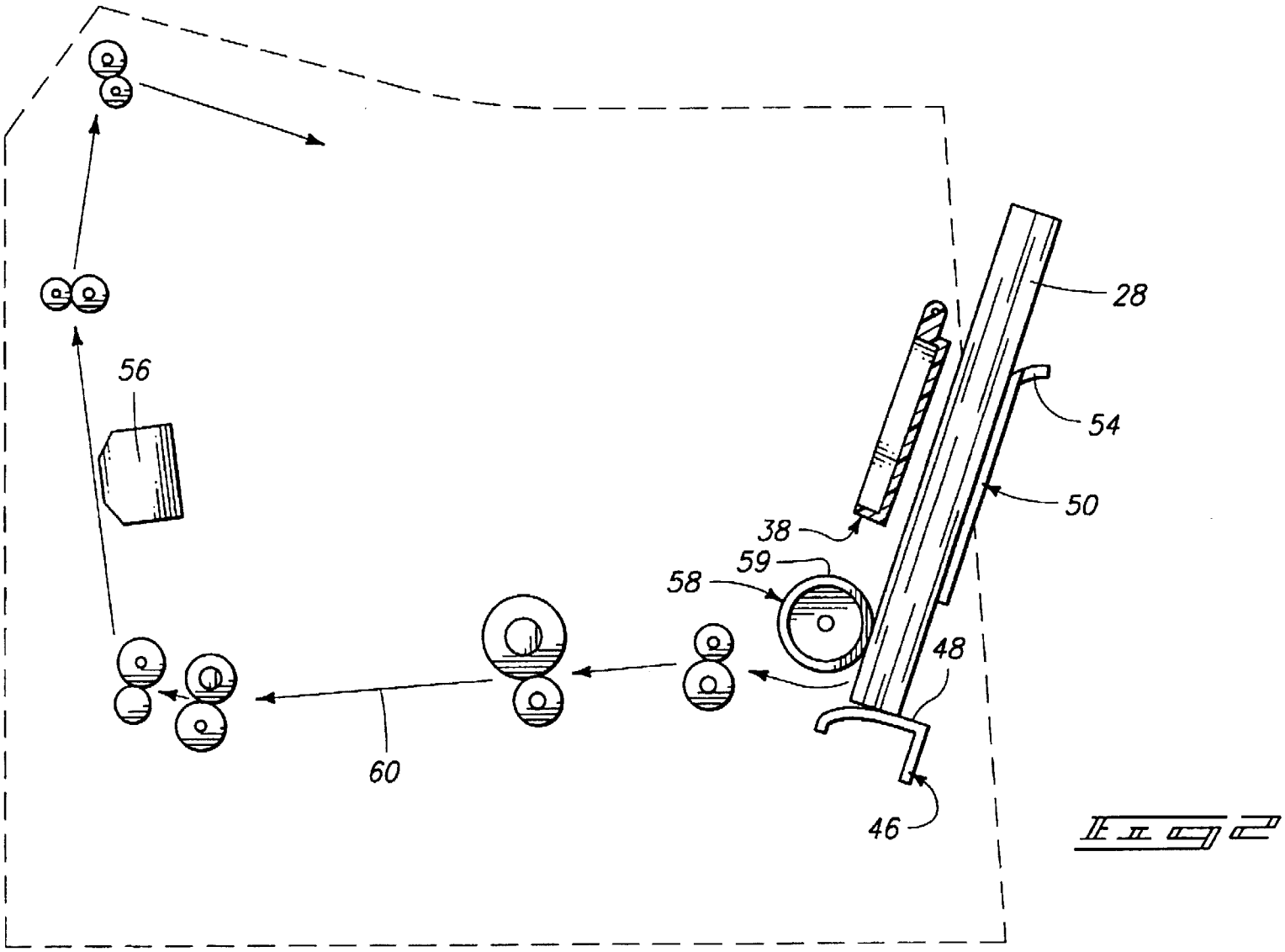
FIG. 2 shows a simplified paper path of the printer of FIG. 1, shows the support in a use position, and shows the door in an open position.

The printer 10 further includes a receptacle 46 in the housing 12, spaced apart from the opening 26, for receiving and engaging the stack 28 (FIG. 2). The receptacle 46 includes an abutment 48 which the inserted end of the stack 28 engages when the stack 28 is inserted into the opening 26 as far as it can go. The abutment 48 is below the opening 26, behind the front, such that the stack 28 is angled, and such that gravity draws the stack 28 toward the abutment 48. The abutment 48 is non-planar. More particularly, in the illustrated embodiment, the abutment 48 is elliptical or arcuate such that paper being fed from the stack 28 can be easily engaged by a feed mechanism (described below) without getting hung up. The receptacle 46 is located in the housing 12 at a distance below the opening 26 and spaced apart from the front such that an angle greater than 45° relative to horizontal is formed at least for a portion of the stack 28 extending between the opening 26 and the receptacle 46. More particularly, in the illustrated embodiment, an angle greater than 60° relative to horizontal is formed at least for a portion of the stack 28 extending between the opening 26 and the receptacle 46. As shown in FIG. 2, when the receptacle 46 receives and engages a stack 28 of 8½ inch×11 inch paper inserted lengthwise (when the stack 28 has been inserted as far as it can go), the stack 28 remains partially outside the housing 12. In the illustrated embodiment, the receptacle 46 is capable of receiving and engaging at least a stack 28 of 8½ inch×11 inch paper, a stack of A4 paper, or a stack of business size envelopes. More particularly, in the illustrated embodiment, the receptacle 46 and the opening 26 are capable of receiving 8½×11 inch paper or A4 paper inserted lengthwise into the opening 26. If stacks 28 of A4 paper or of business size envelopes are inserted lengthwise into the receptacle 46 as far as they can go, they too will extend partially outside the housing 12 so as to be manually removable if they turn out not to be needed.

The printer 10 further includes a support 50 which telescopes from the housing 12 between a use position, where the support inclines upwards and away from the opening 26, and a non-use position where the support does not substantially extend from the housing 12. More particularly, in the illustrated embodiment, the support 50 telescopes from a location of the housing 12 proximate the bottom of the opening 26. The support 50 supports a portion 52 of the stack 28, outside the housing 12, relative to the opening 26 (FIG. 4). The support 50 includes a handle 54. When not in use, the support 50 can be manually pushed down such that an uppermost portion of the support 50 (e.g., the handle 54) is substantially flush with the bottom 32 of the opening 26. In the illustrated embodiment, the support 50 extends from inside the housing 12 to outside the housing 12.

The printer 10 further comprising a print mechanism 56 which receives individual items 29 of printable media from the receptacle 46 and forms images on the individual items. The printer 10 further includes a feed mechanism 58, separate from the receptacle 46, for separately feeding individual items 29 of the stack 28 from the receptacle 46 to the print mechanism along a print path 60. In the illustrated embodiment, the feed mechanism 58 comprises a roller 59 biased toward the front of the printer and engaging a lower portion of the stack 28. In an alternative embodiment, the lower portion of the stack 28 is biased into engagement with the roller 59. Alternative feed mechanisms can be employed. One type of feed mechanism is disclosed in U.S. Pat. No. 5,326,090 to Hock et al. (incorporated herein by reference). After the print mechanism 56 forms images on an item that is travelling along the print path, that item passes out of the housing 12 to an output collection area 62 outside the housing 12. In the illustrated embodiment, the output collection area is defined by a recess in the top of the housing 12.

The printer 10 further includes a paper size selector 64, actuable from outside the housing 12, which selectively guides different sized stacks 28 of paper into the receptacle 46. In the illustrated embodiment, the paper size selector 64 includes manually slidable controls 66 and 68 actuable from the front of the housing 12.

The size selector includes at least one arm having a surface adapted to engage an edge of the paper or other printable media. In a first and second spaced apart arms having parallel surfaces adapted to engage opposite edges of the paper or other printable media. The arms help guide the printable media along the print path. In one embodiment, the two arms are interconnected such that when the first arm is moved towards the second arm, the second arm automatically moves toward the first arm, and when the first arm is moved away from the second arm, the second arm automatically moves away from the first arm. Thus, the parallel surfaces are always equidistant from a point half way between the parallel surfaces. The size selector centers the printable media relative to a point half way between the parallel surfaces of the opposed arms. Different sizes of paper can therefore be centered relative to a print path.

The term "printer" as used in the claims of this application, is intended to encompass any apparatus that prints an image onto paper, such as facsimile machines, photocopiers, or printers that are associated with computer equipment, such as dot matrix printers, bubble jet printers, or laser printers. In the illustrated embodiment of the invention, the printer 10 is a laser printer, and the print mechanism 56 includes a print head in the housing 12 for printing on a sheet of paper. In one embodiment, the printer 10 is a high volume, high speed, laser printer, and the print mechanism 56 comprises a laser print mechanism.

In one embodiment, a plurality of such openings 26 are provided through the housing 12, and have associated supports, etc., and operate in a manner similar to multiple tray printers. In this embodiment, appropriate controls will be provided for automatic or manual selection of the openings 26 from which to feed paper, for selection of paper size or paper type.

Thus, a printer has been provided wherein there is no need for paper trays. Paper can be loaded directly into the front of the printer. When the paper is removed, the paper receiving opening 26 is closed with a door, to protect components inside the housing 12 from exposure to dust and dirt. A printer having a modern streamlined appearance is provided.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A printer comprising:

a housing;

an opening in the housing large enough to receive a stack of items of printable media therethrough, the opening having first and second opposite sides;

a receptacle in the housing, spaced apart from the opening, receiving and engaging the stack wherein, when the receptacle receives and encases the stack, and the stack has a length of 11 inches or greater, and the stack is inserted lengthwise, the stack remains partially outside the housing;

a door pivotally supported by the housing relative to the opening and movable into the housing from a closed position to an open position;

a support extending from inside the housing, proximate the first side of the opening, to outside the housing, the support supporting a portion of the stack, outside the housing relative to the opening, the support sliding from the housing between a use position wherein the support extends away from the housing for supporting a portion of the stack outside the housing, and a non-use position wherein the support does not extend from the housing as much as when in the use position; and a print mechanism supported in the housing.

2. A printer in accordance with claim 1 wherein, when the receptacle receives and engages the stack, and the stack has a length of 11 inches or greater, and the stack is inserted lengthwise, at least 3 inches of the stack length extends into the housing.

3. A printer in accordance with claim 1 wherein the housing has a bottom adapted to sit on a generally horizontal surface and a front extending transversely from the bottom, wherein the opening is through the front, and wherein receptacle is below the opening, such that the stack is angled, and such that gravity draws the stack toward the receptacle.

4. A printer in accordance with claim 1 wherein the receptacle is located in the housing below the opening such that an angle relative to horizontal is formed at least for a portion of the stack extending between the opening and the receptacle.

5. A printer in accordance with claim 3 wherein the receptacle is located in the housing below the opening such that an angle greater than 45° relative to horizontal is formed at least for a portion of the stack extending between the opening and the receptacle.

6. A printer in accordance with claim 1 wherein the support inclines upwardly and away from the opening when the support in the use position.

7. A printer comprising:

a housing;

a print mechanism supported in the housing;

an opening in the housing sized to receive a stack of items of printable media therethrough;

an abutment inside the housing, below the opening, configured to support a stack;

a door spaced apart from the abutment and pivotally supported by the housing relative to the opening and movable into the housing from a closed position, in which the door substantially closes the opening, to an open position; and a spring biasing the door toward the closed position, the spring being overcome when a stack is placed against the door.

8. A printer in accordance with claim 7 wherein, when the abutment supports the stack, and the stack has a length of 11 inches or greater, and the stack is inserted lengthwise, the stack remains partially outside the housing.

9. A printer in accordance with claim 8, wherein the opening has a top and a bottom, and further comprising, a support extending from inside the housing, proximate the bottom of the opening, to outside the housing, the support supporting a portion of the stack, outside the housing, relative to the opening.

10. A printer in accordance with claim 7 wherein, when the abutment supports the stack, and the stack has a length of 11 inches or greater, and the stack is inserted lengthwise, at least three inches of the stack length extends into the housing.

11. A printer in accordance with claim 10 wherein, when the abutment supports the stack, an angle greater than 45° relative to horizontal is formed at least for a portion of the stack extending between the opening and the abutment.

12. A printer comprising:

a housing;

a print mechanism supported in the housing;

an opening in the housing sized to receive a stack of items of printable media therethrough, the opening having a top and a bottom;

an abutment inside the housing, below the opening, supporting the stack, wherein, when the abutment supports the stack, and the stack has a length of 11 inches or greater, and the stack is inserted lengthwise, the stack remains partially outside the housing;

a door pivotally supported by the housing relative to the opening and movable into the housing from a closed position to an open position; and a support extending from inside the housing, proximate the bottom of the opening, to outside the housing, the support supporting a portion of the stack, outside the housing, relative to the opening the support telescoping from the housing between a use position, where the support inclines upwards and away from the opening, and a non-use position where the support does not substantially extend from the housing.

13. A laser printer comprising:

means defining a housing having a bottom for placement on a generally horizontal surface, having a top opposite the bottom, and having a front transverse to the bottom;

means defining a rectangular slot in the front of the housing, between the top and the bottom of the housing, the slot means having a top and bottom, having a height between the top and bottom, and having a width in a direction perpendicular to the height, the slot means receiving a stack of pieces of paper having a width less than the width of the slot means such that the majority of the weight of the stack is supported inside the housing;

means defining a door pivotally supported by the housing means relative to the slot and pivotably movable in a direction into the housing from a closed position to an open position;

biasing means biasing the door means toward the closed position, the biasing means being overcome by gravity operating on a stack which is placed against the door means;

control means for controlling operation of the printer, the majority of the control means being on the front of the housing;

receptacle means in the housing, spaced apart from the slot means, for receiving and engaging the stack;

support means telescopically supported by the housing means for movement between a use position where the support means extends upward and away from a location of the housing means proximate the bottom of the slot means and a non-use position where the support means does not extend from the bottom of the slot, the support means supporting a portion of the stack, outside the housing means, relative to the slot means, the support means having a width less than the width of the slot means;

laser print means in the housing for printing on a sheet of paper; and feed means, separate from the receptacle means, for separately feeding individual pieces of paper of the stack from the receptacle means to the print means.

* * * * *